US010625499B2

(12) United States Patent
Neeb et al.

(10) Patent No.: US 10,625,499 B2
(45) Date of Patent: Apr. 21, 2020

(54) METHOD FOR DETECTING AND COMPENSATING FOR DEFECTIVE PRINT HEADS IN AN INKJET PRINTING MACHINE BY STOCHASTIC PRINT HEAD MONITORING

(71) Applicant: HEIDELBERGER DRUCKMASCHINEN AG, Heidelberg (DE)

(72) Inventors: Steffen Neeb, Bensheim (DE); Nicklas Raymond Norrick, Heddesheim (DE); Andreas Henn, Neckargemuend (DE); Jens Forche, Mannheim (DE); Andreas Fehlner, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/508,358

(22) Filed: Jul. 11, 2019

(65) Prior Publication Data

US 2020/0016889 A1 Jan. 16, 2020

(30) Foreign Application Priority Data

Jul. 11, 2018 (DE) ..... 10 2018 211 463

(51) Int. Cl.
*B41J 2/045* (2006.01)
*B41J 2/21* (2006.01)
*B41J 2/165* (2006.01)

(52) U.S. Cl.
CPC ..... *B41J 2/0451* (2013.01); *B41J 2/04536* (2013.01); *B41J 2/04558* (2013.01);
(Continued)

(58) Field of Classification Search
CPC ..... B41J 2/0451
See application file for complete search history.

(56) References Cited

U.S. PATENT DOCUMENTS 5,587,730 A 12/1996 Karz
6,238,112 B1 * 5/2001 Girones ..... B41J 2/2139 347/19

(Continued)

FOREIGN PATENT DOCUMENTS

DE 102018204312 B3 2/2019

*Primary Examiner* — Shelby L Fidler
(74) *Attorney, Agent, or Firm* — Laurence A. Greenberg; Werner H. Stemer; Ralph E. Locher

(57) ABSTRACT

A method for detecting and compensating for defective print heads in an inkjet printing machine uses a computer to analyze printing nozzle test charts and/or area coverage elements to obtain characteristic values of individual printing nozzles in a print head, to calculate the failure probabilities of these printing nozzles on the basis of thresholds, and to compensate for a printing nozzle that exceeds a specified failure probability. The computer uses the individual failure probabilities of the individual printing nozzles in a print head to calculate the failure probability of the print head and initiates compensation measures as a function of the calculation. The thresholds correspond to a multi-dimensional characteristic value threshold based on which the computer calculates the failure probability of a printing nozzle by using an algorithm including kernel density estimation through a multidimensional distribution function.

10 Claims, 6 Drawing Sheets

(52) U.S. Cl.
CPC ..... *B41J 2/04586* (2013.01); *B41J 2/165* (2013.01); *B41J 2/2142* (2013.01)

(56) References Cited

U.S. PATENT DOCUMENTS

| | | | | |
|---|---|---|---|---|
| 2002/0027575 | A1* | 3/2002 | Bruch | B41J 2/0451 347/19 |
| 2004/0046811 | A1* | 3/2004 | D'Souza | B41J 2/04508 347/12 |
| 2006/0098251 | A1* | 5/2006 | Eklund | B41J 2/16579 358/504 |
| 2010/0165022 | A1 | 7/2010 | Makuta et al. | |

* cited by examiner

METHOD FOR DETECTING AND COMPENSATING FOR DEFECTIVE PRINT HEADS IN AN INKJET PRINTING MACHINE BY STOCHASTIC PRINT HEAD MONITORING

CROSS-REFERENCE TO RELATED APPLICATION

This application claims the priority, under 35 U.S.C. § 119, of German Patent Application DE 10 2018 211 463.3, filed Jul. 11, 2018; the prior application is herewith incorporated by reference in its entirety.

BACKGROUND OF THE INVENTION

Field of the Invention

The present invention relates to a method for detecting and compensating for defective print heads in an inkjet printing machine by using stochastic print head monitoring.

The technical field of the invention is the field of digital printing.

In inkjet printing machines, defective printing nozzles exhibiting defects, for instance failure, reduced functioning, or print dot misplacement, that remain undetected cause waste, i.e. printed products that cannot be sold. The aim is to avoid such defects as much as possible and to ensure production without waste or at least with minimized waste. The quality of every single printing nozzle is described by specific characteristic values such as volume, jetting angle, gray value, i.e. values that are obtained from recordings of suitable test charts and by suitable image processing operations. The characteristic values are usually obtained at predefined intervals during an ongoing printing operation.

Since the quality of a printing nozzle may change due to contamination, measures are taken to retain sufficient print quality whenever a specified threshold is exceeded. Those measures include purging, various print head washing programs, and even print head replacement. Those issues are relevant for production at the location of the customer, but also at the quality control department during assembly. A criterion commonly used for that purpose is the number of missing printing nozzles, which is obtained by a number of individual rules in conjunction. Another criterion is the standard deviation of the trajectory of all printing nozzles in a print head. Data for both approaches are obtained in a single measuring operation.

Individual missing nozzles may be compensated for by causing neighboring printing nozzles that still work properly to jet increased amounts of ink. That aspect is taken into consideration when a decision is made as to whether a print head needs to be replaced because compensation by adjacent nozzles requires a minimum distance of working printing nozzles between missing printing nozzles.

Moreover, the current methods do not minimize so-called type I and type II errors. Type I errors refer to the question of how many printing nozzles are actually working properly but have been switched off and compensated for, while type II errors refer to how many printing nozzles are actually defective but are not being compensated for. Those errors either result in an unnecessary implementation of compensation or compensatory measures on both the printing nozzle level and the print head level, including the aforementioned purging, washing, and print head replacements or in print quality deterioration. Thus, strictly speaking, the known methods require a stable jetting process without variation of the characteristic values of the printing nozzles. However, in practice, that assumption is unrealistic.

Therefore, characteristic values are determined multiple times, i.e. multiple measurements are taken. If a characteristic value obtained in any one of those measurements exceeds the predefined value, the printing nozzle is considered defective. The consequence is that the number of defective printing nozzles rises. Moreover, that number is dependent on the number of measurements, i.e. in processes that exhibit variation, with every further measurement, there is a chance that further printing nozzles exhibit rule violations. A large number of measurements will eventually cause all printing nozzles to be labeled as missing nozzles. In addition, the result is a categorical, quasi-binary classification, i.e. an individual printing nozzle may either be good or bad, but its actual analog condition is not taken into consideration.

U.S. Patent Application Publication No. 2010/0165022 A1 discloses a method that describes an inkjet printing machine including an inspection system in which a method is implemented to come to a decision in terms of measures to be taken. The criterion that is used in the method described in the document is a type of failure probability, which is based on the number of failed nozzles.

German Patent Application DE 10 2018 204 312 B3 discloses another approach and strategy on the aforementioned subject to obtain a weighted, optimized determination of thresholds that simulates a human assessment of the printed product in an optimum way. Those thresholds may be used to form a statistical prediction model that predicts for every printing nozzle the probability of exceeding a print quality threshold on the basis of previous measured values. The use of thresholds that have been optimally adapted to simulate a human assessment reduces type I and type II errors (in management terms referred to as the producer risk and the consumer risk) and minimizes the risk of wrong decisions. That may likewise be done in a weighted way: For instance, if the consumer risk is ten times more important than the producer risk, the weighted total risk may be minimized in that way. However, the present application restricts itself entirely to a probability-based determination of thresholds for the individual printing nozzles and consequently on the detection of and compensation for those printing nozzles. The print head itself is not considered in any detail.

In addition, U.S. Pat. No. 5,587,730 B discloses a thermal inkjet printer with redundant printing capabilities. That inkjet printer includes a primary print head for printing ink drops in a first color and a secondary print head for printing ink drops in the first color and/or in other colors. The secondary print head selectively prints in accordance with a first mode or with a second mode. In the first mode, the secondary print head complements the primary print head in such a way that both print heads print ink drops in the first color. In the second mode, the secondary print head prints ink drops in the first color instead of the primary print head when the primary print head fails.

SUMMARY OF THE INVENTION

It is accordingly an object of the invention to provide a method for detecting and compensating for defective print heads in an inkjet printing machine by stochastic print head monitoring, which overcomes the hereinafore-mentioned disadvantages of the heretofore-known methods of this general type.

With the foregoing and other objects in view there is provided, in accordance with the invention, a method for detecting and compensating for defective print heads in an inkjet printing machine by using a computer, wherein the computer analyzes printing nozzle test charts and/or area coverage elements to determine characteristic values for individual printing nozzles in a print head, calculates the failure probabilities of these printing nozzles on the basis of thresholds, and compensates for a printing nozzle that exceeds a specified failure probability, in which the computer uses the individual failure probabilities of the individual printing nozzles in a print head to calculate the failure probability of the print head and initiates compensatory measures as a function of the calculation. According to the method, the thresholds correspond to a multidimensional characteristic value threshold based on which the computer calculates the failure probability of a printing nozzle by using an algorithm including kernel density estimation through a multi-dimensional distribution function.

The core aspect of the method of the invention is that the calculated individual failure probabilities of the individual printing nozzles in a print head are interlinked in such a way that they may be used to calculate the failure probability of the print head in question for the print head as a whole. Once the failure probability has been calculated, a decision may be made as to whether any measures are to be taken for compensatory purposes and potentially on the nature of the measures to be taken. In this context, the failure probability always exclusively describes the status quo, which is described by the characteristic values as a function of the last preceding measurements. In order to assess the failure probability in terms of a decision on the necessity of further measures, a threshold likewise seems expedient. An important aspect is to understand that in general, the characteristic values are multidimensional characteristic values. This means that it is not an individual characteristic value that is calculated but multiple different characteristic values that are considered simultaneously. Therefore, the thresholds that are used to determine the failure probability of the individual printing nozzles are multidimensional characteristic value thresholds. This calculation is then made by the algorithm, preferably by using the kernel density estimation, which applies a multidimensional distribution function to calculate the failure probability of a printing nozzle in terms of the multidimensional characteristic values and characteristic value threshold that is likewise multidimensional. If a calculation by using kernel density estimation is impossible, a normal distribution may be assumed.

Advantageous and thus preferred further developments of the method will become apparent from the associated dependent claims and from the description together with the associated drawings.

Another preferred development of the method of the invention in this context is that the characteristic values of the individual printing nozzles are formed from a series of individual measurements and are described statistically by the computer. In accordance with the method of the invention, to calculate the failure probability of a specific print head, it is of course necessary first to determine the failure probabilities of the individual printing nozzles. This is done by measuring, determining, and assessing the characteristic values of the individual nozzles in a series of individual measurements. The assessment occurs by a statistical description, namely in the sense that the individual characteristic values are statistically recorded over the series of individual measurements, which means that the variation of individual characteristic values over time is recorded in a corresponding way. After this statistical description, the characteristic values are treated mathematically. This is done in that they are combined with the aid of mathematical operators in such a way that a comparison between this series of characteristic values and the threshold is possible. An important aspect in this context is to make a prognosis for an assumed future development of the characteristic values on the basis of the determined series of characteristic values. The failure probability then results from the probability for the prognosticated continued characteristic values to exceed the threshold.

A further preferred development of the method of the invention in this context is that the computer calculates the failure probability of the print head by multiplying with one another the non-failure probabilities of n adjacent printing nozzles of a printing nozzle found to be defective in the print head as a result of the analysis of the printing nozzle test charts and/or the area coverage elements, thus to obtain a compensatability for every defective printing nozzle, and that the failure probability of the print head is then calculated on the basis of these compensation probabilities. Once the failure probabilities of the individual printing nozzles are known, in accordance with the invention, the failure probability of the entire print head that includes the printing nozzles in question needs to be calculated. This is not done by considering the failure probability of individual printing nozzles but by multiplying the non-failure probabilities of printing nozzles respectively adjacent printing nozzles that have been identified as defective. Thus, a compensation probability is calculated for every one of these printing nozzles. These compensation probabilities may then be used to calculate the failure probability of the entire print head. This is logical because a print head is only deemed unusable once its individual defective printing nozzles may no longer be compensated for. Basically, the approach may be summed up as follows: for every printing nozzle identified as defective, the printing nozzle in question and the adjacent printing nozzles required for compensation are combined to form a package. In general, the two respective printing nozzles to the left and right of a defective printing nozzle are used for compensation purposes, which means that for every defective printing nozzle, a package of five is created. In order to assess the compensation probability of the defective printing nozzle, the non-failure probabilities of the adjacent printing nozzles are used. Since a defective or missing printing nozzle is compensated for by its adjacent printing nozzles in virtually every case, a decisive factor that determines the failure probability of the entire print head is the number of printing nozzles that cannot be compensated for by the adjacent printing nozzles. The described method is used to establish this for all printing nozzles in the print head, and then these compensation probabilities are used to calculate the failure probability of the entire print head.

An added preferred development of the method of the invention in this context is that the computer calculates the failure probability of the print head on the basis of the compensation probabilities of every printing nozzle found to be defective by multiplying these compensation probabilities with one another. The failure probability of the print head logically results from a multiplication of the individual compensation probabilities. If the result of this multiplication of the individual compensation probabilities is too low, measures to reestablish compensatability of the print head need to be taken. However, if these measures are unsuccessful and if the failure probability of the print head thus rises beyond a specific threshold, the print head needs to be replaced.

An additional preferred development of the method of the invention in this context is that to calculate the failure probability of the print head, only the non-failure probabilities of those n adjacent printing nozzles that have not already been declared defective and switched off are multiplied with one another. An important aspect is that to calculate the failure probability of the print head through the compensation probabilities of defective printing nozzles, of course only the non-failure probabilities of printing nozzles that have not been declared defective themselves may be multiplied with one another in such a package of five. For in this case, the central printing nozzle of the package of five has been identified as defective and switched off and is no longer compensatable. The compensation probability for the printing nozzle in question would of course be zero. An alternative way to proceed is to leave out the intermediate step of calculating the compensation probability of the individual printing nozzles that have been identified as defective and switched off and simply to multiply all non-failure probabilities of the respective adjacent printing nozzles over the entire print head with one another. The result is the non-failure probability of the entire print head, which may then be used to calculate the failure probability of the entire print head. Whether to leave out the intermediate step of calculating the compensation probability of the individual nozzle or not is the operator's choice. The bottom line is that it does not matter whether the failure probability of the print head is calculated through the intermediate step of calculating the compensation probabilities of the individual printing nozzles that have been identified as defective or simply by immediately multiplying all non-failure probabilities of the adjacent printing nozzles with one another. In both cases, the printing nozzles that have been identified as defective may not be used to calculate the failure probability/compensation probability because factoring them in would prevent a mathematical calculation of the failure probability of the print head since their respective value is zero. Due to the versatility of the individual factors in such a multiplication the information on compensation probabilities of the individual printing nozzles are included in the calculated total failure probability of the print head from the start even though they may no longer be individually identified. If such an individual determination of the compensation probability of an individual printing nozzle is not necessary, the intermediate step may be eliminated without difficulty.

Another preferred development of the method of the invention in this context is that to initiate compensatory measures, in addition to the failure probability, the computer also takes into consideration whether one of the n adjacent printing nozzles of a printing nozzle that has been declared defective and switched off has likewise been declared defective and switched off. In a case in which an individual printing nozzle that has been identified as defective and switched off cannot be compensated for, because in the relevant package of five there is at least one further printing nozzle that is likewise defective, this aspect needs to be factored-in, in addition to the calculated failure probability of the print head. Although, as indicated above, these printing nozzles may not be factored-in when the failure probability of the print head is calculated, clearly the information that there is such an individual printing nozzle that cannot be compensated is extremely important for any assessment of the status of the print head in question and ought not to be ignored.

An added preferred development of the method of the invention in this context is that the computer calculates the failure probability of the print head by selecting the lowest value among the compensation probabilities of every defective printing nozzle. An alternative assessment criterion for assessing the print head is to find the worst case. The way to do this is not to multiply the compensation probabilities of all printing nozzles that have been identified as defective and switched off but instead simply to select the worst compensation probability and to use it as the worst-case value for the entire print head. In this case, the lowest compensation probability of a printing nozzle forms the failure probability of the entire print head.

An additional preferred development of the method of the invention in this context is that the compensatory measures include purging, washing, and replacing the print head and are initiated when the failure probability of the print head exceeds a specified threshold. When the failure probability of the entire print head exceeds a specified threshold, the aforementioned compensatory measures need to be carried out to ensure that the print head stays usable or is made usable again. In most cases, purging, i.e. pressing ink through the printing nozzles at a high pressure, or washing are sufficient to get enough individual printing nozzles to function again and thus to decrease the total failure probability of the print head below the threshold. If this is not sufficient, the print head needs to be replaced.

Another preferred development of the method of the invention in this context is that to calculate the individual failure probabilities of the individual printing nozzles in a print head, the computer takes the position of the printing nozzles in the print head into consideration. The position of the printing nozzles in the print head, i.e. for instance in which print head row the printing nozzle is situated or whether it is on the margin, also plays a part in terms of printing nozzle performance and failure probability. Therefore, the position of the printing nozzle ought to be taken into consideration in a corresponding way when the failure probability is calculated.

A concomitant preferred development of the method of the invention in this context is that when the individual failure probabilities of the individual printing nozzles in a print head are calculated, the printing behavior of every individual printing nozzle is weighted by applying a loss function to the characteristic value progression. The progression of the characteristic value, which plays a part when the individual failure probability of a printing nozzle is calculated, is the result of the variation of the individual characteristic value measurements. If there is wide variation yet still within the tolerances, the failure probability is similar to a case of low variation. In order to prevent this aspect and to reflect the wider variation of the characteristic values in the calculated failure probabilities of the individual printing nozzles, a so-called loss function is superposed on the characteristic value progression. This function has the shape of a parabola, for instance. The result is a minimal loss for characteristic values that are close to the optimum targets of the respective characteristic value and a greater loss for characteristic values that are closer to the threshold.

Other features which are considered as characteristic for the invention are set forth in the appended claims.

Although the invention is illustrated and described herein as embodied in a method for detecting and compensating for defective print heads in an inkjet printing machine by stochastic print head monitoring, it is nevertheless not intended to be limited to the details shown, since various modifications and structural changes may be made therein without departing from the spirit of the invention and within the scope and range of equivalents of the claims.

The invention as such as well as further developments of the invention that are advantageous in structural and/or functional terms will be described in more detail below with reference to the associated drawings and based on at least one preferred exemplary embodiment. The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
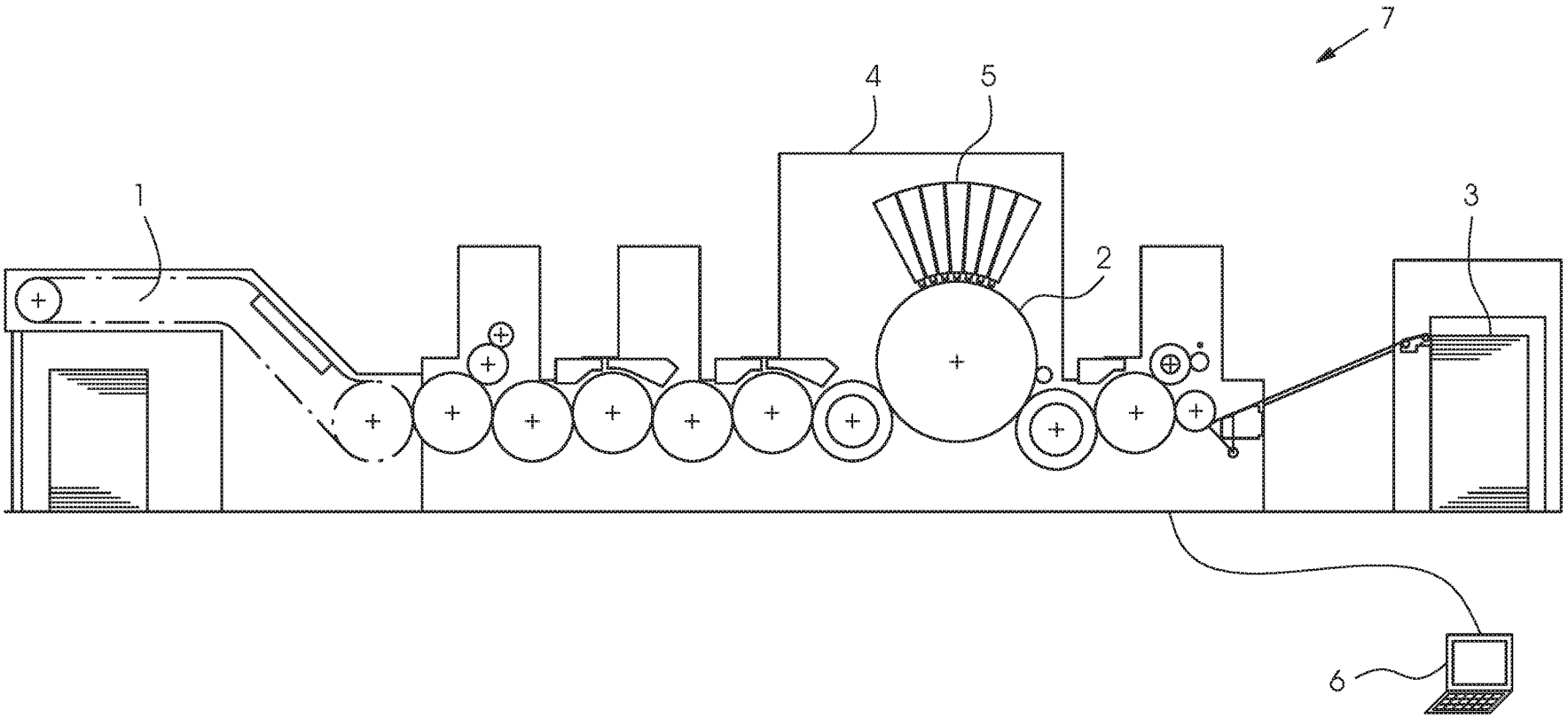
FIG. 1 is a diagrammatic, longitudinal-sectional view of an example of the structure of a sheet-fed inkjet printing machine.
Figure 2:
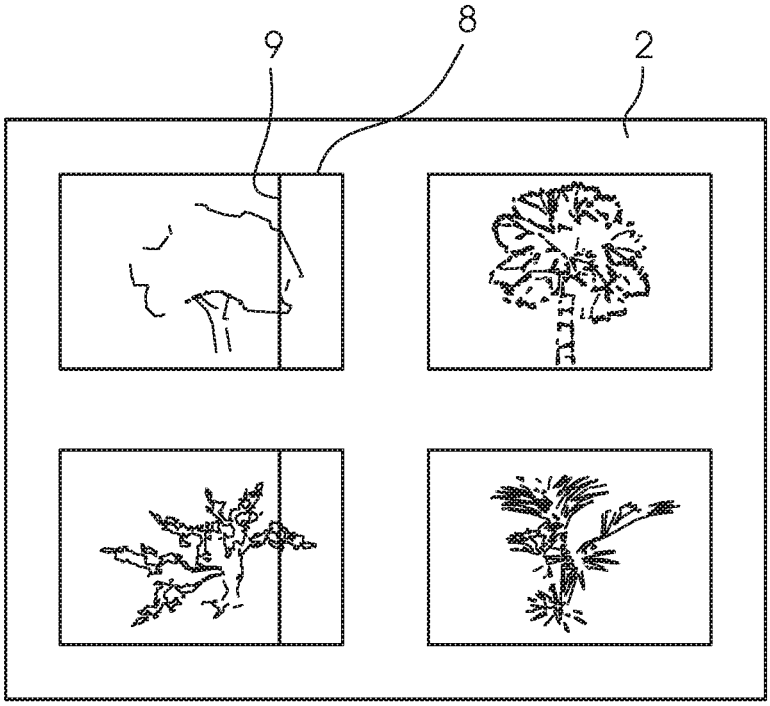
FIG. 2 is a top-plan view of a printing substrate illustrating a schematic example of a white line caused by a missing nozzle.

Referring now in detail to the figures of the drawings, in which mutually corresponding elements have the same reference symbols, and first, particularly, to FIG. 1 thereof, it is seen that the field of application of the preferred exemplary embodiment is an inkjet printing machine 7. FIG. 1 shows an example of the fundamental construction of such a machine 7, including a feeder 1 for feeding a printing substrate 2 to a printing unit 4 where it receives an image printed by print heads 5 and from which it is then fed to a delivery 3. The machine is a sheet-fed inkjet printing machine 7 controlled by a control unit or controller 6. While this printing machine 7 is in operation, individual printing nozzles in the print heads 5 in the printing unit 4 may fail as described above. Such a failure results in white lines 9 or, in the case of multicolor printing, in distorted color values. An example of such a white line 9 in a printed image 8 is shown in FIG. 2.

The foundation of the method of the invention is a weighted optimum determination of the thresholds as it is known from the prior art. They are determined by a statistical prediction model that predicts a probability 12 for every nozzle to exceed a print quality threshold 16 on the basis of previous measurements. It describes how to obtain such a multidimensional characteristic value threshold 16 or, in a one-dimensional case, a threshold value 16 if there is only one type of characteristic value. The characteristic value threshold 16 is used in connection with the level of the current characteristic values to indicate a failure probability 12 for every single nozzle. The characteristic values are formed from a series of individual measurements. An important aspect in this context is that they are described statistically and are accordingly treated mathematically. The method of the invention is implemented in a computer-assisted way and the preferred computer is the aforementioned control unit 6 of the printing machine 7.

Figure 3:
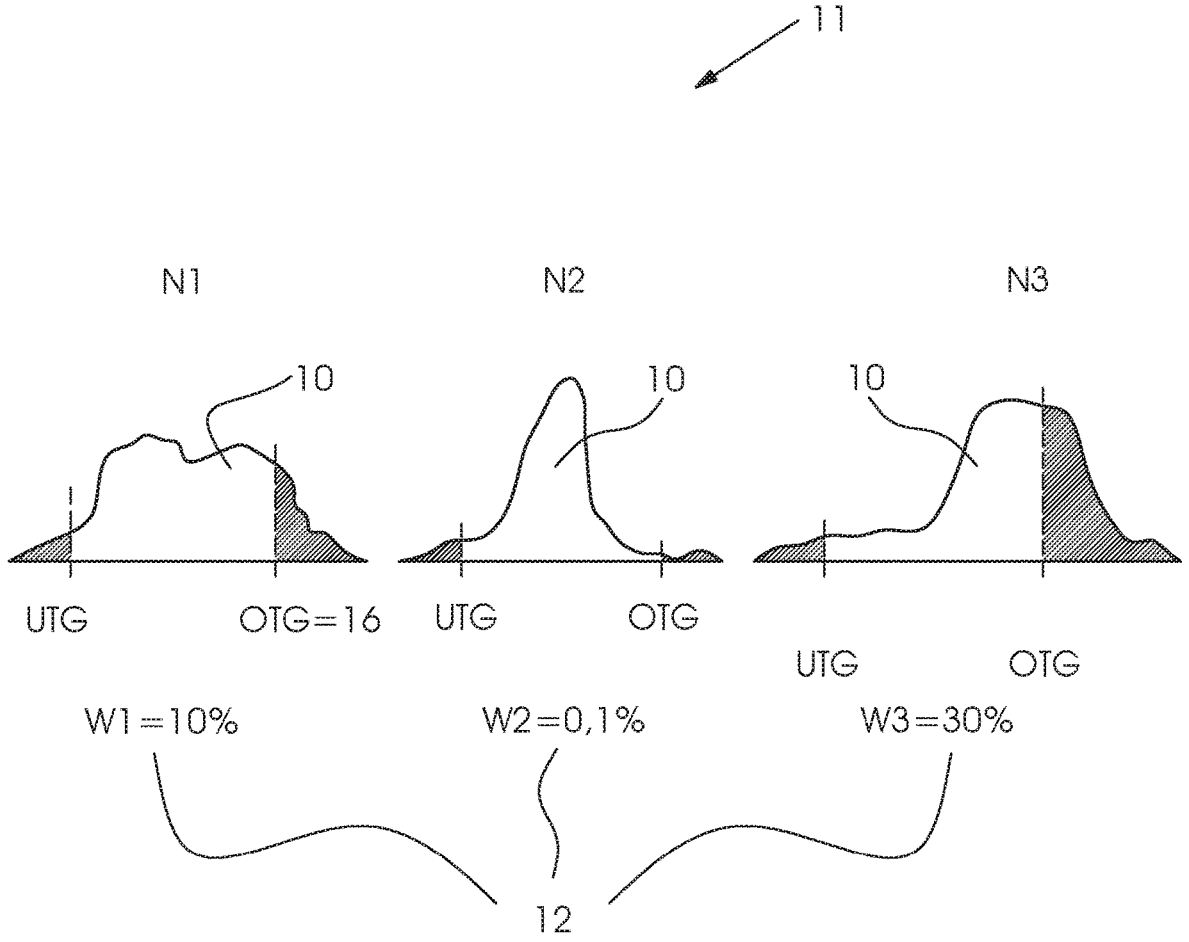
FIG. 3 includes diagrams illustrating the application of kernel density estimation to three printing nozzles.
Figure 4:
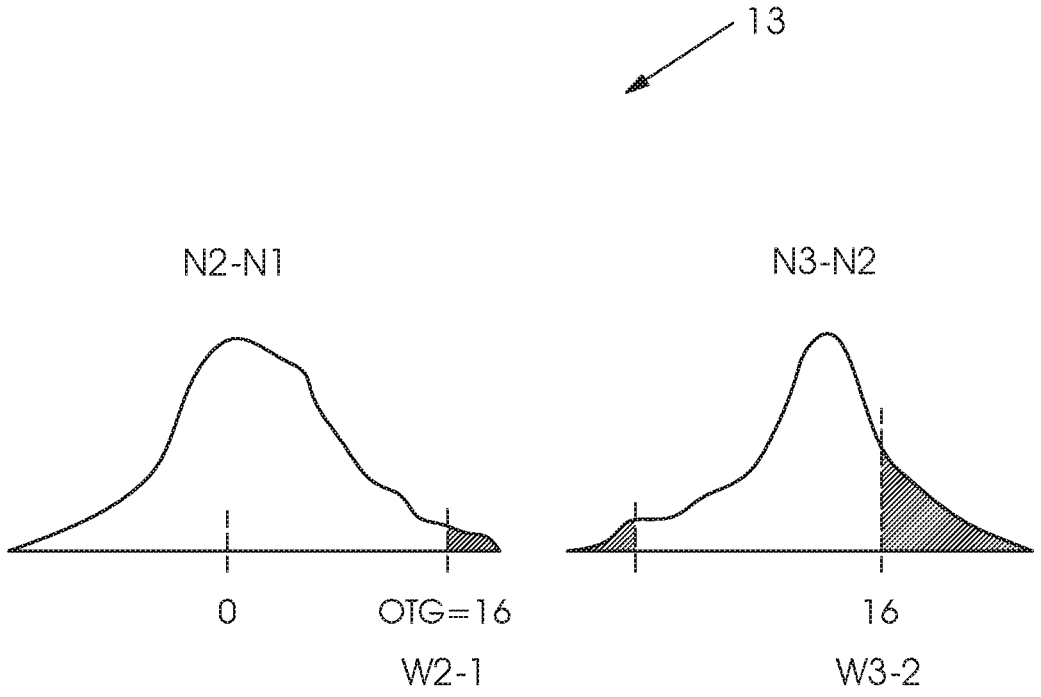
FIG. 4 includes diagrams illustrating the difference of the kernel density estimation of neighboring printing nozzles.
Figure 6:
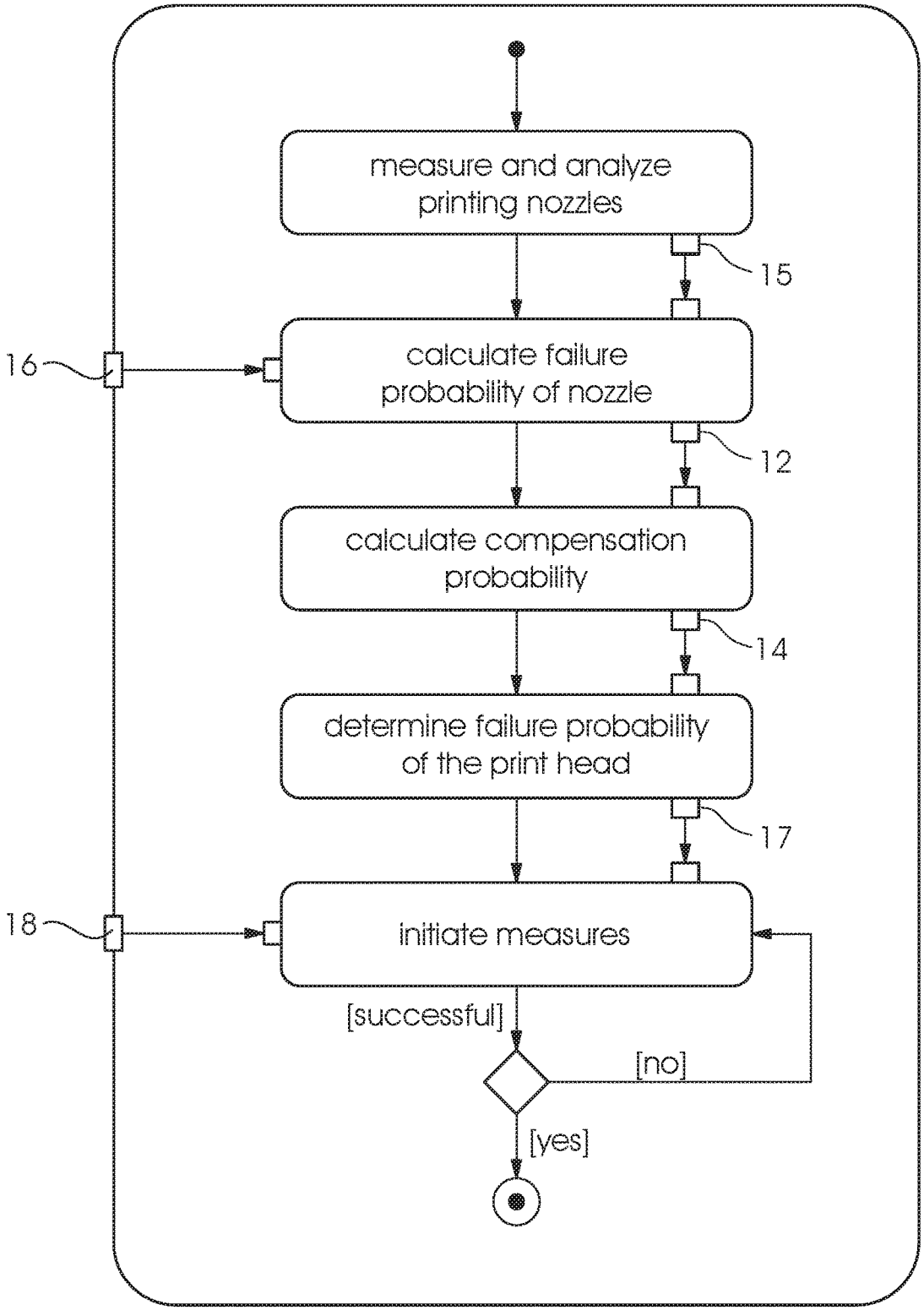
FIG. 6 is a flow chart of the method of the invention.

FIG. 6 is a schematic flow chart of the preferred embodiment of the method of the invention. In order to implement the method of the invention, it is necessary to print printing nozzle test charts, to scan them by using a camera, and to assess a test chart image 15 that has been digitized in this way in terms of printing nozzle quality. In a preferred embodiment, at least 30 test chart prints and corresponding measurements are required to provide a sufficient data base. The camera that is used is preferably the image inspection system of the inkjet printing machine 7, which is an in-line system located in the inkjet printing machine. Then for every printing nozzle, a multidimensional distribution density function is estimated on the basis of the measurements, i.e. the digitized test chart images 15, with the aid of so-called kernel density estimation. An example of such a kernel density estimation 11 is shown in FIG. 3, which illustrates a printing range between lower and upper tolerance thresholds (UTG-OTG) 10 of three printing nozzles N1-N3 and an actual print development. The better the printing nozzle prints within the desired range 10, the lower the failure probability W 12 of the printing nozzle. In order to ascertain this result, a preferred embodiment may include the additional superposition of a loss function to the printing range (UTG-OTG) 10. Such a loss function results in minimum losses for characteristic values that are close to the optimum print result and greater losses the closer the characteristic values get to the tolerance thresholds (UTG, OTG). Then an exceedance probability 13 is calculated for every printing nozzle on the basis of the multidimensional characteristic value threshold by calculating the difference between the neighboring printing nozzles. FIG. 4 shows this for the printing nozzles N1 to N3 shown in FIG. 3. The reason for calculating the difference is that such a calculation allows print dot deviations of individual printing nozzles to be detected that are within the tolerance for the individual printing nozzle and are therefore not be detected. For instance, if a printing nozzle prints towards the left but still barely within the tolerance and the printing nozzle to the left of it prints towards the right but also still barely within the tolerance, the end result may be a visible artifact even though the individual printing nozzles do not exceed any tolerances. However, calculating the difference causes it to be detected. The failure probability 12 of the individual printing nozzles are then linked in such a way that a total failure probability 17 of a print head 5. This failure probability 17 of a print head 5 is then used to initiate measures 18 such as purging, washing. If these measures are successful, the printing operation may continue in a normal way. However, if they remain unsuccessful, they need to be iteratively repeated, i.e. starting with simple measures such as purging, moving on to various washing programs and finally on to replacing the print head.

What needs to be borne in mind at all times to understand the method of the invention is the fact that a print head 5 virtually always has printing nozzles that are known to be defective and have therefore been switched off. There are n printing nozzles on every side of a defective printing nozzle which are required to compensate for these defective printing nozzles and, in general, n equals 2. Thus, packages of five nozzles are created for every printing nozzle that has been switched off. These are: the printing nozzle that has been switched off at the center, 2 printing nozzles to the left and 2 printing nozzles to the right. The individual failure probabilities 12 in a package of five are linked by multiplying the non-failure probabilities of the two left-hand and right-hand printing nozzles. The non-failure probability is calculated as 1−failure probability. A compensation probability 14 of the printing nozzle that has been switched off and is at the center of the package of five may be derived from this. The compensation probability 14 is the probability that a further printing nozzle within the package of five in question may fail, causing the defective printing nozzle that has been switched off to be no longer compensatable because it violates the package-of-five rule. The printing nozzle in question will thus create a white line 9 that cannot be compensated for. If this is the case, measures 18 need to be taken for the print head 5. In contrast, if there are other printing nozzle failures in other locations, i.e. not within the package of five, they may be compensated for and do not require immediate measures 18. In the following run, these failures will be taken into consideration for the assessment in a corresponding way.

If there are multiple packages of five, the resultant individual probabilities 12 may be statistically combined. For this purpose there are various options:

1. a worst case approach or
2. multiplying the non-failure probabilities 12.

For the worst case approach, the lowest compensation probability 14 is selected, i.e. the compensation probability 14 of the package of five for which compensation by the respective neighboring four printing nozzles is most improbable.

Figure 5:
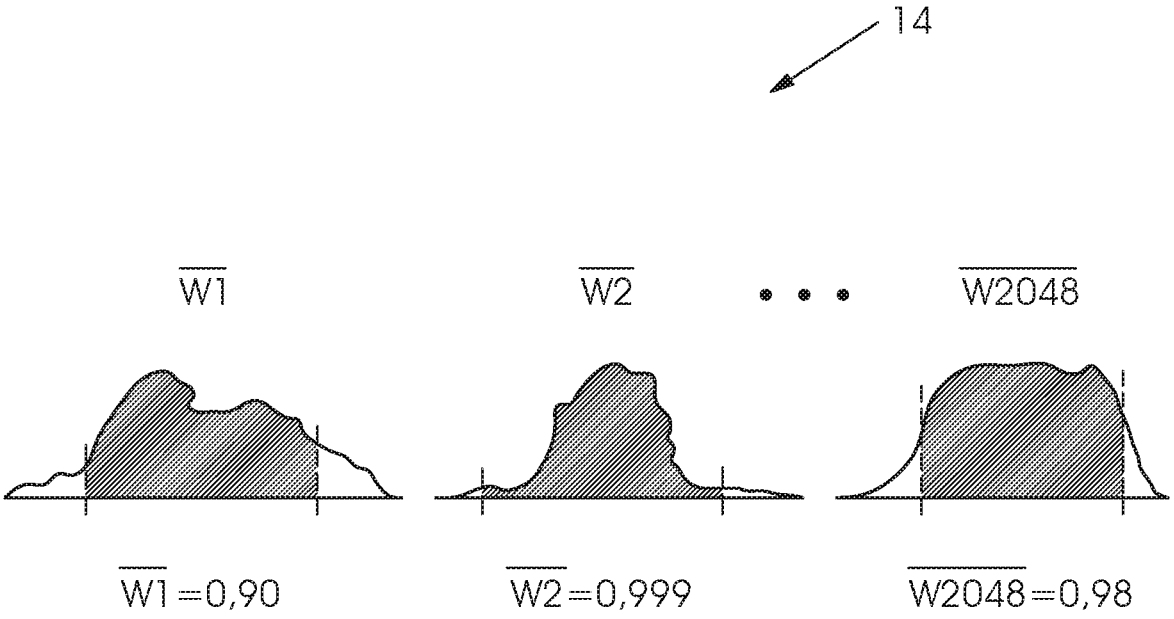
FIG. 5 includes diagrams illustrating the accumulated probability that the printing nozzles may contribute to compensating for defective adjacent printing nozzles.

In the second case, the N=2048 individual non-failure probabilities 12 are multiplied with one another to obtain a broad characterization of a print head and thus to provide a quality criterion in the form of print head performance (PHD). By way of example, FIG. 5 illustrates three printing nozzles N1, N2 and N=2048 and their respective non-failure probabilities 12, showing that the three printing nozzles print in the desired range (UTG-OTG) and are therefore suitable for compensating for a potential defective printing nozzle in the vicinity. The intermediate step of calculating compensation probabilities 14 of the packages of five may, but does not have to, be dispensed with. The known defective printing nozzles need to be eliminated from the multiplication because their non-failure probability is zero, which would harm the calculation. Thus, the absolute compensation capability of the print head 5 is not taken into consideration in this quality criterion.

The bottom line is that two characteristic quality values of the print head 5 are available and may be used to make decisions: the worst-case compensation probability 14 and the total failure probability of the print head 18. The two characteristic values may in fact be combined. The bottom line is that the resultant print head performance is a function of the probabilities of all printing nozzles that do not contribute to compensating for a printing nozzle and print within defined tolerances, and the compensation capability of all printing nozzles that contribute to compensation.

The definition of a failure probability 12 threshold at which measures 18 such as purging, washing, and even print head replacement need to be taken is above all a function of the quality requirements of the final product. If they tolerate white lines 9, the measures 18 need not be taken immediately but rather when a minimum quality requirement is no longer met.

The basic difference from the prior art is that the decisions are no longer made on a quantitative basis but on the basis of probabilities. In the prior art, the result is either good or bad. In contrast, the method proposed herein indicates a continuous failure probability for the entire print head 5.

Advantages

Decisions are not made on a quantitative basis but on the basis of probabilities, which is much more reliable because there is more information content.

No or fewer working printing nozzles are switched off in error and no or fewer defective printing are not switched off, resulting in cost savings due to the reduced number of measures 18 such as purging, washing, print head replacement and due to a greater productivity of the inkjet printing machine.

In the prior art, the result is either good or bad. The method of the invention provides a failure probability for the entire print head 5.

The following is a summary list of reference numerals and the corresponding structure used in the above description of the invention:

1 feeder
2 current printing substrate/current print sheet
3 delivery
4 inkjet printing unit
5 ink jet print head
6 computer
7 inkjet printing machine
8 printed image on the current print sheet
9 white line
10 allowed printing area (UTG-OTG)
11 kernel density estimation
12 (non-)failure/failure probability of printing nozzle
13 exceedance probability
14 compensation probability
15 digitized test chart image
16 characteristic value threshold
17 total failure probability of the print head
18 print head quality measures

The invention claimed is:

1. A method for detecting and compensating for defective print heads in an inkjet printing machine; the method comprising the following steps:

using a computer to analyze at least one of printing nozzle test charts or area coverage elements to obtain characteristic values for individual printing nozzles in a print head;

using the computer to calculate failure probabilities of the printing nozzles on a basis of thresholds;

using the computer to compensate for a printing nozzle exceeding a specified failure probability;

using the computer to calculate the failure probability of a printing nozzle by using an algorithm including kernel density estimation through a dimensional distribution function based on the thresholds corresponding to a multi-dimensional characteristic value threshold; and initializing compensation measures, using the computer, as a function of a failure probability of the print head calculated by utilizing the individual failure probabilities of the individual printing nozzles in the print head.

2. The method according to claim 1, which further comprises forming the characteristic values of the individual printing nozzles from a series of individual measurements and using the computer to statistically describe the characteristic values.

3. The method according to claim 1, which further comprises using the computer to calculate the failure probability of the print head by multiplying with one another non-failure probabilities of n adjacent printing nozzles of a printing nozzle identified as defective in the print head as a result of the analysis of at least one of the printing nozzle test charts or the area coverage elements, to obtain a compensation probability for every defective printing nozzle, and then using the computer to calculate the failure probability of the print head based on the compensation probabilities.

4. The method according to claim 3, which further comprises based on the compensation probabilities for every printing nozzle identified as defective, using the computer to calculate the failure probability of the print head by multiplying the compensation probabilities with one another.

5. The method according to claim 4, which further comprises calculating the failure probability of the print head by multiplying with one another only the non-failure probabilities of those n neighboring printing nozzles that have not already been declared defective and switched off.

6. The method according to claim 4, which further comprises initiating compensation measures by using the computer to take into consideration, in addition to the failure probability of the print head, whether one of the respective n adjacent printing nozzles of a printing nozzle that has been declared defective and been switched off has likewise been declared defective and been switched off.

7. The method according to claim 3, which further comprises using the computer to calculate the failure probability of the print head by selecting a lowest value among the compensation probabilities for every defective printing nozzle.

8. The method according to claim 1, which further comprises selecting the measures for compensation as purging, washing or replacing the print head, and initiating the measures for compensation when the failure probability of the print head exceeds a specified threshold.

9. The method according to claim 1, which further comprises using the computer to calculate the individual failure probabilities of the individual printing nozzles in a print head by taking a position of the printing nozzles in the print head into consideration.

10. The method according to claim 1, which further comprises weighting a printing behavior of every single printing nozzle by applying a loss function to a characteristic value progression, when calculating the individual failure probabilities of the individual printing nozzles in a print head.

* * * * *